United States Patent [19]

Riley et al.

[11] 4,231,568

[45] Nov. 4, 1980

[54] EXERCISE MACHINE WITH SPRING-CAM ARRANGEMENT FOR EQUALIZING THE FORCE REQUIRED THROUGH THE EXERCISE STROKE

[76] Inventors: Robert Q. Riley, 6835 E. Sheena Dr., Scottsdale, Ariz. 85254; David L. Carey, 13627 N. 18th Dr., Phoenix, Ariz. 85029

[21] Appl. No.: 7,427

[22] Filed: Jan. 29, 1979

[51] Int. Cl.[3] ..... A63B 21/04

[52] U.S. Cl. ..... 272/136; 272/143; 272/134; 272/142

[58] Field of Search ..... 272/136, 142, 143, 144, 272/DIG. 4, DIG. 3, 130, 132, 135, 138, 116, 118, 140, 141; 128/25 R

[56] References Cited

U.S. PATENT DOCUMENTS

| | | | |
|---|---|---|---|
| 3,373,993 | 3/1968 | Oja et al. | 272/142 X |
| 3,638,941 | 2/1972 | Kulkens | 272/142 X |
| 3,858,873 | 1/1975 | Jones | 272/DIG. 4 X |
| 3,912,261 | 10/1975 | Lambert | 272/118 |
| 4,149,714 | 4/1979 | Lambert | 272/144 X |

*Primary Examiner*—Richard C. Pinkham
*Assistant Examiner*—William R. Browne
*Attorney, Agent, or Firm*—William H. Drummond

[57] ABSTRACT

An exercise machine with a user-actuated force-applying member utilizes a spring to resist the physical force applied by the user. The physical force is applied to the spring through a cam arrangement which equalizes the force required throughout the exercise stroke.

1 Claim, 8 Drawing Figures

EXERCISE MACHINE WITH SPRING-CAM ARRANGEMENT FOR EQUALIZING THE FORCE REQUIRED THROUGH THE EXERCISE STROKE

This invention relates to an exercise machine.

In another aspect, the invention pertains to an exercise machine with a user-actuated force-applying member.

In yet another respect, the invention concerns exercise machine apparatus of the type described, in which the physical force required to move the force-applying member is equalized throughout the exercise stroke.

Typical prior art exercise machines provide various combinations of levers and cables which the user can actuate to exercise, strenghthen and tone various specific muscles of his body. Such prior art machines commonly employ weights suspended on cables which are attached by pulley systems to the force-applying member such as a lever or a bar or handrings attached to the end of the cable.

Because of the complexity of the pulley systems required in machines which utilize weights to bias the force-applying members, the typical prior art exercise machine is fairly large and relatively expensive.

To reduce the size, complexity and cost of exercise machines employing weight-biased force-applying members, it has been proposed to employ coil springs rather than weights to bias the force-applying members against the physical force exerted thereon by the user, for example as shown in U.S. Pat. Nos. 3,118,441, 3,298,688, 3,373,993, 3,558,131 and 3,638,941.

Several of these prior art devices also provide means for varying the spring bias applied against the force-applying member to provide variable levels of physical force which must be exerted by the user to move the force-applying member. However, in common with all other spring-biased exercise devices of the prior art, these devices do not provide, for any one setting of the spring adjustment, for the application of a constant bias against the force-applying member throughout the exercise stroke. Such constant bias is both desirable and required to attain optimum results in various of the possible exercise modes.

Constant bias against the force-applying member is provided by typical weight-biased exercise devices and, in order to achieve the desired reduction in size, complexity and cost by using spring-biasing means instead of weight-biasing, it would be highly desirable to provide a spring-baised exercise machine which requires substantially equal physical force to move the force-applying member through all portions of the exercise stroke.

Accordingly, it is the principal object of the present invention to provide an improved spring-biased exercise machine.

Yet another object of the present invention is to provide a spring-biased exercise machine of modest size, complexity and cost which also provides the desired substantially constant biasing force against the force-applying member throughout the exercise stroke, which was heretofore provided only in larger, more complicated and more expensive weight-biased systems.

These and other, further and more specific objects and advantages of the invention will be apparent to those skilled in the art from the following detailed description thereof, taken in conjunction with the drawings, in which.

Briefly, in accordance with our invention, we provide improvements in prior art spring-biased exercise machines. Such prior art machines normally include a frame, a force-applying member carried by and movable with respect to the frame through an exercise stroke in response to physical force exerted thereon by a user, and spring means carried by the frame to resist the physical force applied by the user through the exercise stroke. The improvement which we provide comprises force-equalizing means operatively associated with the spring means and the force-applying member, for equalizing the physical force required to move the force-applying member throughout the exercise stroke.

In the presently preferred embodiment of the invention, the force equalizing means comprise a cam-pulley combination journalled for rotation in the frame and operatively interconnected by flexible cables between the movable end of the spring and the force-applying member. The cam surface shape is selected to continuously compensate for the variation in force required to deflect the spring as the force-applying member is moved through the exercise stroke.

Figure 1:
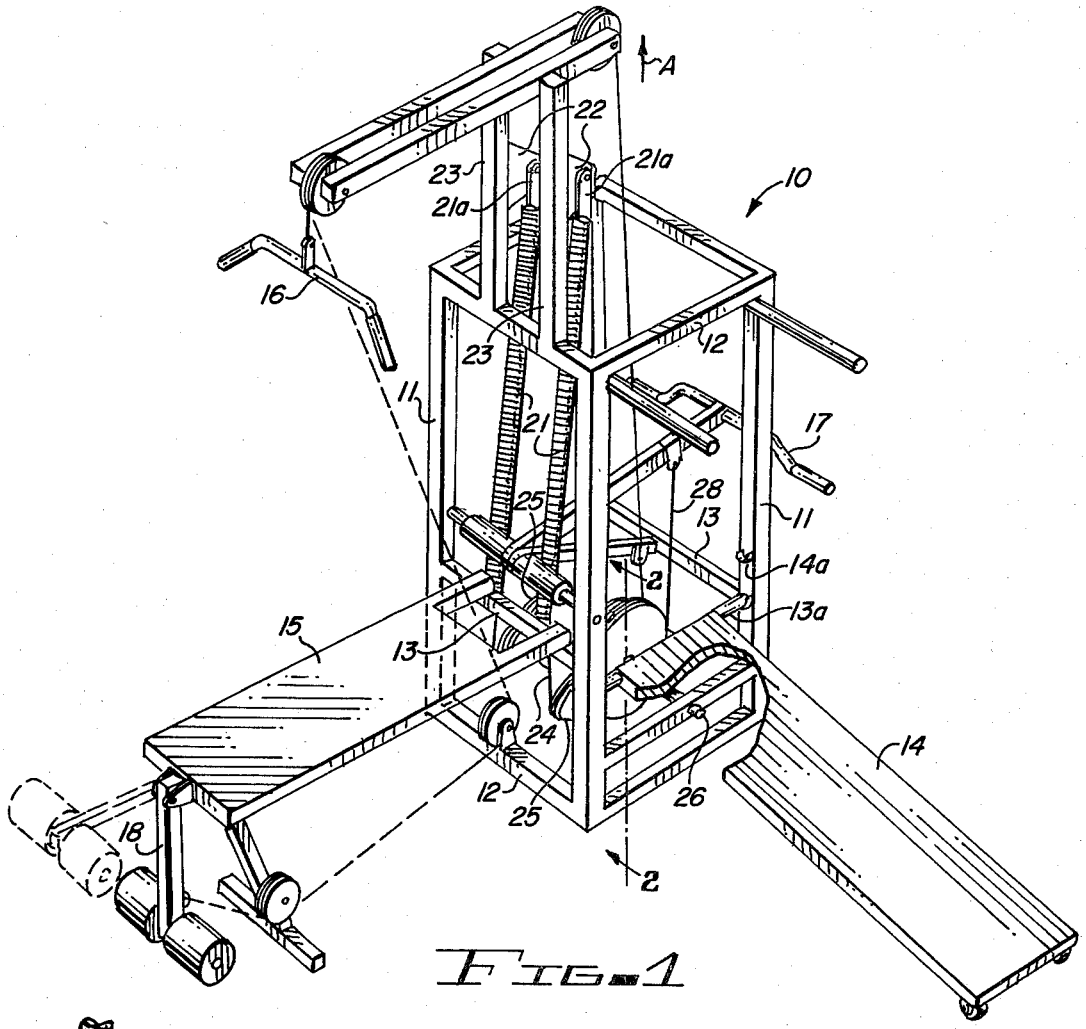
FIGS. 1 and 1A is a perspective view of an exercise machine embodying the principles of the present invention.
Figure 1A:
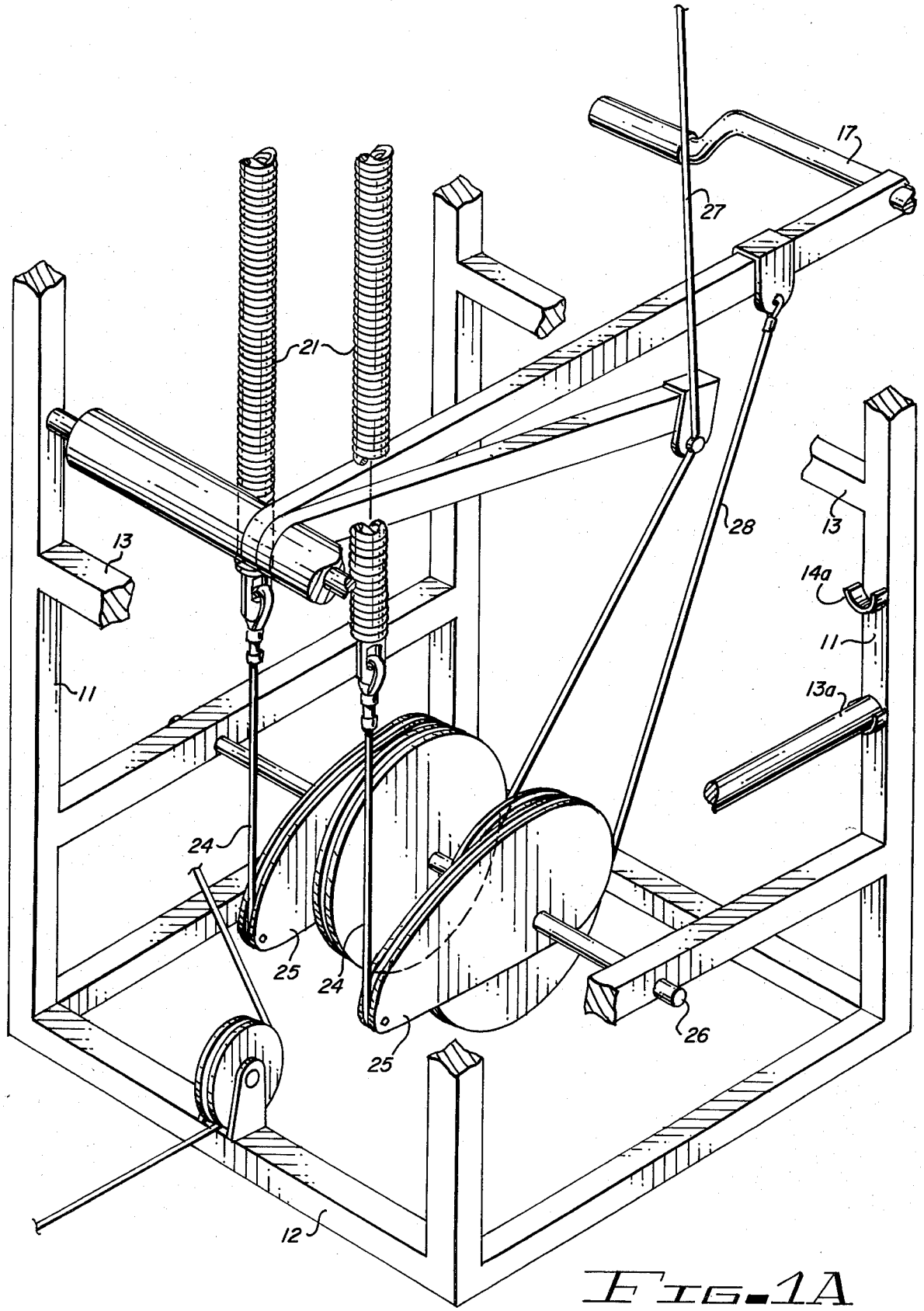

Turning now to the drawings, in which the presently preferred embodiments of the invention are depicted for purposes of illustration and not by way of limitation, FIGS. 1 and 1A depicts an exercise machine which includes a frame generally indicated by reference character 10 comprising vertical members 11 and horizontal members 12 fashioned from any suitable material, typically square steel tubing, and secured at their respective ends by welding or bolting. Additional intermediate cross members 13 may be provided to serve as supports for a slantboard 14 and a bench 15. The bench 15 can be repositioned to the opposite side of the frame from that shown in FIG. 1 to provide for additional exercise modes. Various force-applying members are provided, such as a pull-down bar 16, a pressing bar 17 and a leg-curl fixture 18. The slantboard 14 can be adjusted to various angles by varying the position of the bar **13*a* in the brackets 14*a***.

A pair of coil springs 21 are carried within the frame 10. The fixed ends **21*a* of the springs 21 are pitovally attached to ears 22 carried on upright supports 23 extending upwardly from the frame 10. The lower free ends of the springs 21 are attached by cables 24 to the "long-radius" end of cams 25 which are carried on a horizontal axle 26 carried by the frame 10**.

The springs 21 can be extended under tension exerted by force applied to any one of the force-applying members. Force applied in the direction of the arrow A on the flexible cable 27 is transmitted through the cam-pulley arrangement (described below) to extend the springs 21. This force can be exerted either by pulling downwardly on the pull-down bar 16 or by rotating the leg-curl fixture 18 upwardly to the position shown by the dashed lines. Similarly, upward pressure on the pressing bar 17 tensions cable 28 and the force is transmitted through the cam-pulley arrangement to extend the springs 21.

Figure 2A:
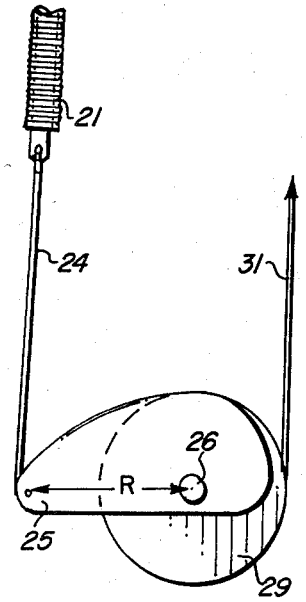
FIGS. 2A and 2B are side views of the cam-pully member combination which compensates for the change in force required to extend the spring-biasing member throughout its total deflection.
Figure 2B:
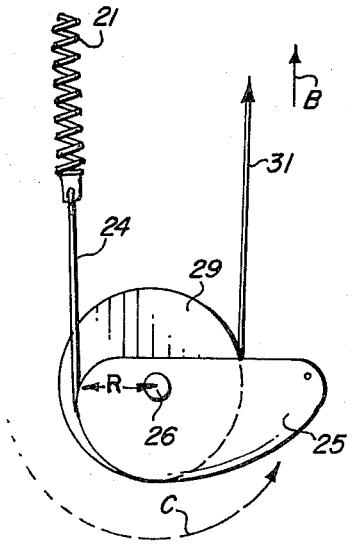
Figure 3:
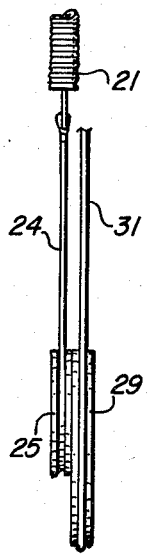
FIG. 3 is an end view of the cam-pulley combination of FIGS. 2A and 2B.

The operation of the device of FIG. 1 is further illustrated in FIGS. 2A, 2B and 3. As shown in FIG. 2A, the free end of the coil spring 21 is attached by flexible cable 24 to the long-radius end of a grooved cam 25. A cylindrical pulley 29 is fixed for rotation with the cam 25 on the axle 26. Flexible cable 31 extends through appropriate pulleys to any of the force-applying members, as shown in FIG. 1. The position of the cam-pulley combination and spring is shown in FIG. 2A with the spring fully compressed, i.e., with no tension on cable 31. As force is exerted on any one of the force-applying members, the cable 31 will be tensioned in the direction of the arrow B, as shown in FIG. 2B, and the cam-pulley combination will rotate in the direction of the arrow C, winding the cable 24 onto the sheave formed on the periphery of the cam 25 as the spring 21 is extended under tension. The relationship of the elements of FIGS. 2A–2B is further illustrated in the end view thereof in FIG. 3.

In operation, the exercise machine of FIGS. 1–3 provides a constant spring bias against the force-applying members throughtout their respective exercise strokes. As is well known in the art, the force required to extend a coil spring varies with the total deflection of the spring. In the case of a cylindrical coil spring, the force required to extend the spring a given distance becomes greater and greater as the spring is extended from its relaxed to its fully deflected condition. Depending on various factors in the design of the spring, the change of force required to deflect the spring at various points from its relaxed to fully deflected state will vary according to well-known mathematical formulae. Consequently, the exact slope of the cam surface required to compensate for this variation will vary somewhat. However, as will be recognized by those skilled in the art, the shape of the cam will be adjusted such that the effective radius of the cam R will vary to provide an effective lever between the cable 24 and the cam axle 26. Such effective lever, when applied to overcome the spring force, will result in a constant tension being applied to the cable 31 as the spring is moved from the relaxed state, as shown in FIG. 2A, to the fully extended state, as shown in FIG. 2B.

Figure 4:
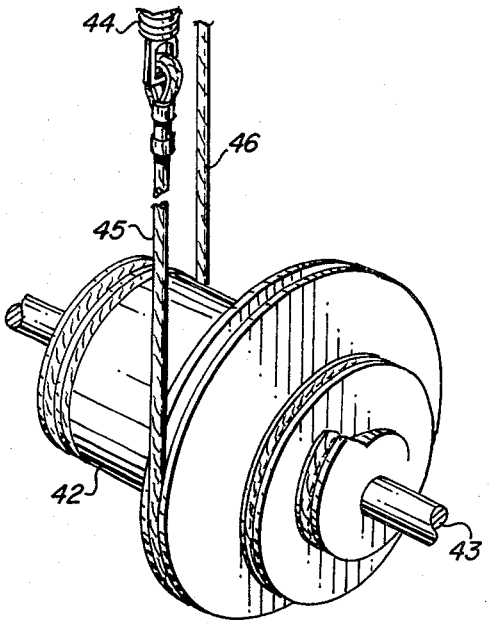
FIGS. 4, 5 and 6 depict an alternate arrangement for providing constant bias against the force-actuating member by compensating for the variations in force required to deflect the spring at various total spring delection points.
Figure 5:
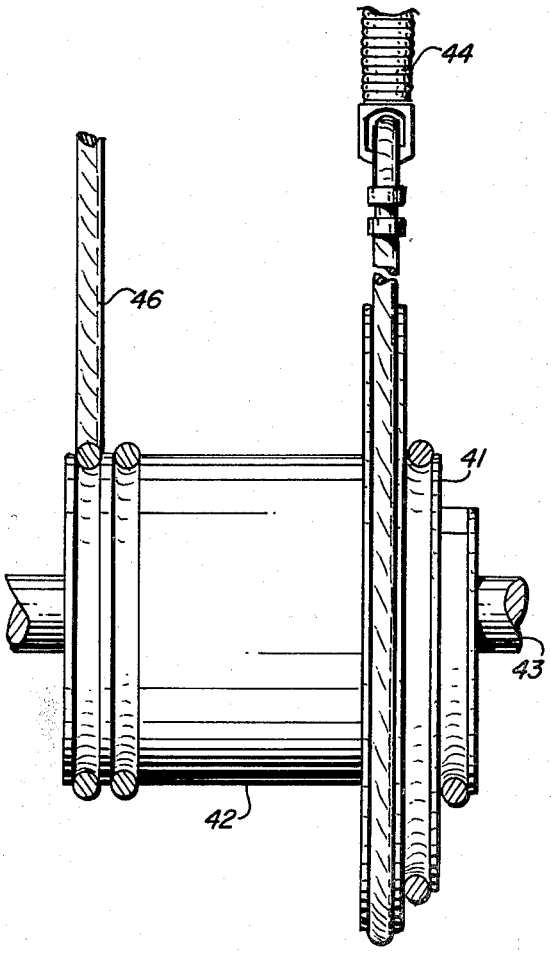
Figure 6:
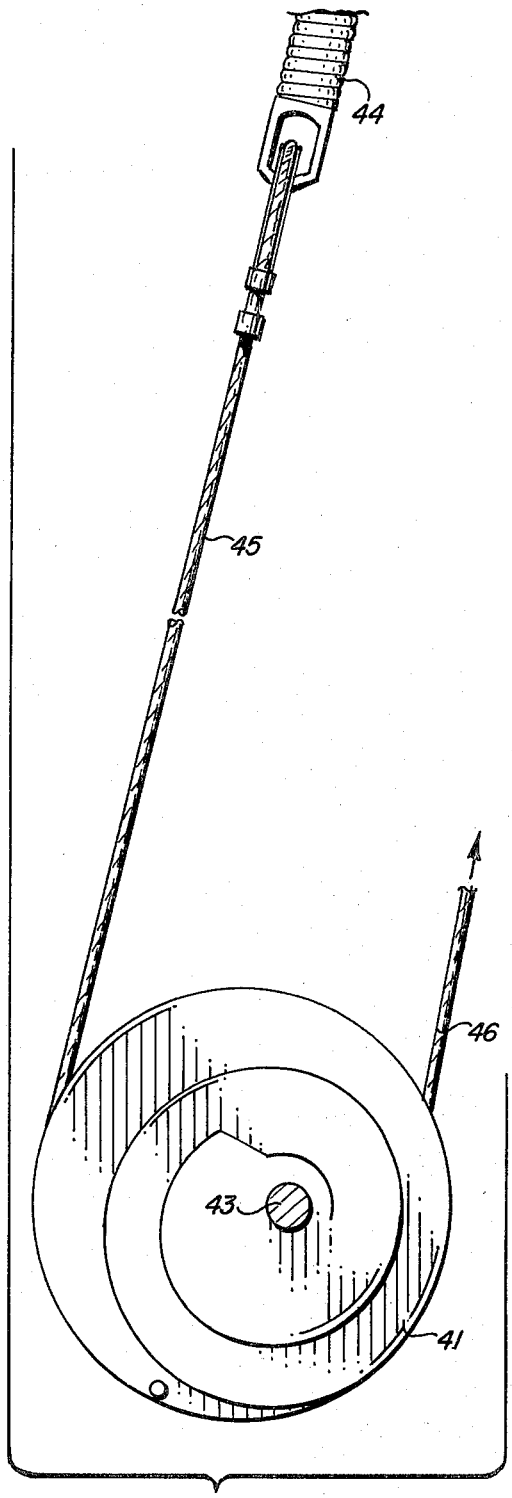

The same effect can be achieved by means other than the cam-pulley combination shown in FIGS. 2A-B. For example, as shown in FIGS. 4–6, the cam surface can be effectively provided by a grooved spiral pulley 41 with an integrally formed cylindrical drum 42 mounted for rotation upon or with a common axle 43. The spring 44 is attached by flexible cable 45 to the spiral pulley 41 and a flexible cable 46 wound on drum 42 is connected by appropriate pulleys to the force-applying members of the machine of FIG. 1. As in the case of the cam-pulley combination of FIGS. 2–3, the slope of the grooves of the spiral pulley 41 is selected according to art-recognized techniques to compensate for the variations in the force required to extend the spring at various points from its fully relaxed to its fully extended position.

Having described our invention in such terms as to enable those skilled in the art to which it pertains to understand and practice it, and having identified the presently preferred embodiments thereof, we claim:

1. In an exercise machine which includes a frame, a force-applying member carried by and movable with respect to said frame through an exercise stroke in response to physical force exerted thereon by a user, and spring means carried by said frame to resist the physical force applied by the user through said exercise stroke, the improvement comprising:

force equalizing means, operatively associated with said spring means and said force-applying member, for equalizing the physical force required to move said force-applying member throughout said exercise stroke against the increased force required to elongate the spring means when said force-applying member is moved in the direction to elongate the spring means.

* * * * *